US007111605B2

(12) United States Patent
Bale et al.

(10) Patent No.: US 7,111,605 B2
(45) Date of Patent: Sep. 26, 2006

(54) SYSTEM FOR MODIFYING FUEL PRESSURE IN A HIGH-PRESSURE FUEL INJECTION SYSTEM FOR FUEL SYSTEM LEAKAGE TESTING

(75) Inventors: Carlton G. Bale, Columbus, IN (US); Bart Dye, Columbus, IN (US); Johnny G. Gipson, Nashville, IN (US)

(73) Assignee: Cummins, Inc., Columbus, IN (US)

( * ) Notice: Subject to any disclaimer, the term of this patent is extended or adjusted under 35 U.S.C. 154(b) by 41 days.

(21) Appl. No.: 10/618,229

(22) Filed: Jul. 11, 2003

(65) Prior Publication Data

US 2005/0005880 A1 Jan. 13, 2005

(51) Int. Cl.
*F02B 77/08* (2006.01)

(52) U.S. Cl. ..... 123/198 D; 123/456

(58) Field of Classification Search ..... 123/357, 123/359, 494, 198 D, 456; 73/119 A, 49.7, 73/117, 118.1
See application file for complete search history.

(56) References Cited

U.S. PATENT DOCUMENTS 3,938,377 A * 2/1976 Converse et al. ..... 73/117
4,125,894 A * 11/1978 Cashel et al. ..... 701/123
4,520,773 A * 6/1985 Koslow ..... 123/198 A
5,020,362 A * 6/1991 Hart et al. ..... 73/119 A
5,117,683 A * 6/1992 Phillips ..... 73/119 A
5,179,922 A 1/1993 Bartholomew
5,187,974 A 2/1993 Mellits et al.
5,384,714 A 1/1995 Kidd
5,461,908 A * 10/1995 Armstrong ..... 73/118.1
5,616,837 A 4/1997 Leonard et al.
5,646,341 A 7/1997 Schricker et al.
5,685,268 A * 11/1997 Wakemen ..... 123/198 D
5,715,786 A 2/1998 Seiberth
5,731,515 A 3/1998 Tominaga et al.
5,795,995 A 8/1998 Shimaoka et al.
5,974,865 A 11/1999 Dambach
6,119,058 A 9/2000 Anderberg
6,164,123 A 12/2000 Corkill
6,282,945 B1 9/2001 Weldon et al.
6,308,119 B1 10/2001 Majkowski et al.
6,564,616 B1 * 5/2003 Antonioli et al. ..... 73/49.7
6,712,045 B1 * 3/2004 McCarthy, Jr. ..... 123/456

* cited by examiner

*Primary Examiner*—Carl S. Miller
(74) *Attorney, Agent, or Firm*—Barnes & Thornburg LLP

(57) ABSTRACT

A system is disclosed for modifying fuel pressure in a high-pressure fuel injection system of an internal combustion engine for subsequent fuel system leak testing. The fuel pressure in a fuel collection unit of the fuel injection system is increased to a fuel pressure near a maximum allowable fuel collection unit fuel pressure value while maintaining low engine load.

26 Claims, 5 Drawing Sheets

SYSTEM FOR MODIFYING FUEL PRESSURE IN A HIGH-PRESSURE FUEL INJECTION SYSTEM FOR FUEL SYSTEM LEAKAGE TESTING

FIELD OF THE DISCLOSURE

The present invention relates generally to systems for conducting fuel system leakage testing, and more specifically to systems for modifying the pressure level of high-pressure fuel in a high-pressure fuel injection system for subsequent fuel system leakage testing.

BACKGROUND OF THE DISCLOSURE

It is desirable to conduct leak testing in high-pressure fuel systems to identify high-pressure fuel leak conditions for subsequent repair or replacement of defective components. It is further desirable to conduct such fuel system leak testing while the vehicle is stationary and at low engine loads.

SUMMARY OF THE DISCLOSURE

The present invention may comprise one or more of the following features or combinations thereof. A system for modifying fuel pressure in a high-pressure fuel injection system of an internal combustion engine may comprise a fuel collection unit configured to store high-pressure fuel therein, at least one fuel injector configured to supply fuel from the fuel collection unit to the engine, and means for controlling fuel pressure within the fuel collection unit to a target fuel pressure near a maximum allowable fuel collection unit fuel pressure level while maintaining low engine load.

The system may further include a vehicle speed sensor producing a vehicle speed signal indicative of road speed of a vehicle carrying said engine, and the means for controlling fuel pressure may further include means for controlling fuel pressure within the fuel collection unit to the target fuel pressure while maintaining low engine load only while the vehicle speed signal indicates that the vehicle is not moving.

Alternatively or additionally, the system may further include an engine speed sensor producing an engine speed signal indicative of the rotational speed of the engine, and the means for controlling fuel pressure may further include means for controlling fuel pressure within the fuel collection unit to the target fuel pressure while maintaining low engine load only while the engine speed signal indicates that the rotational speed of the engine is within a predefined range of engine speeds.

Alternatively or additionally, the system may further include a pressure sensor producing a pressure signal indicative of fuel pressure within the fuel collection unit, and the means for controlling fuel pressure may further include means for controlling fuel pressure within the fuel collection unit to the target fuel pressure while maintaining low engine load only while the pressure signal indicates that the fuel pressure within the fuel collection unit is below a fuel pressure limit.

The means for controlling fuel pressure may further include means for modifying the fuel pump control signal to a fuel pump configured to supply high pressure fuel to the fuel collection unit to control the fuel pressure within the fuel collection unit to the target fuel pressure.

The means for controlling fuel pressure may further include means for controlling fuel pressure within the fuel collection unit to a target fuel pressure near a maximum allowable fuel collection unit fuel pressure level while maintaining low engine load and while controlling rotational speed of the engine to a target engine speed value.

The means for controlling fuel pressure within the fuel collection unit to a target fuel pressure near a maximum allowable fuel collection unit fuel pressure level while maintaining low engine load and while controlling rotational speed of the engine to a target engine speed value may further include means for modifying the fueling command signal to the at least one fuel injector to control the rotational speed of the engine to the target engine speed value.

The means for controlling fuel pressure may further include means for maintaining low engine load by maintaining a vehicle carrying the engine in a stationary position.

The means for controlling fuel pressure may include a control structure configured to control the fuel pressure within the fuel collection unit to a target fuel pressure near a maximum allowable fuel collection unit fuel pressure level while maintaining low engine load.

The control structure may includes a control computer configured to control fuel pressure within the fuel collection unit and to control engine fueling, and an auxiliary computer connected in electronic communication with the control computer, the auxiliary computer configured to direct the control computer to control the fuel pressure within the fuel collection unit to the target fuel pressure while maintaining low engine load.

Alternatively, the control structure may include a control computer configured to control fuel pressure within the fuel collection unit and to control engine fueling, the control computer further configured to control the fuel pressure within the fuel collection unit to the target fuel pressure while maintaining low engine load.

A method for modifying fuel pressure in a high-pressure fuel injection system of an internal combustion engine, wherein the high-pressure fuel injection system includes a fuel collection unit storing high-pressure fuel therein and at least one fuel injector supplying fuel from the fuel collection unit to the engine, may comprise controlling engine load to within a range of low engine loads, and controlling fuel pressure within the fuel collection unit to a target fuel pressure near a maximum allowable fuel collection unit fuel pressure level while maintaining engine load within the range of low engine loads.

The method may further include controlling engine speed to within a range of engine speeds prior to controlling fuel pressure to the target fuel pressure.

The act of controlling engine load to within a range of low engine loads may include maintaining a vehicle carrying the engine in a stationary position.

The method may further include continually executing the act of controlling fuel pressure within the fuel collection unit only while a vehicle carrying the engine is not moving.

The method may further include continually executing the act of controlling fuel pressure within the fuel collection unit only while engine rotational speed is within a predefined range of engine speeds.

The method may further include continually executing the act of controlling fuel pressure within the fuel collection unit only while the fuel pressure within the fuel collection unit is below a fuel pressure limit.

These and other objects of the present invention will become more apparent from the following description of the illustrative embodiments.

DESCRIPTION OF THE ILLUSTRATIVE EMBODIMENTS

Figure 1A:
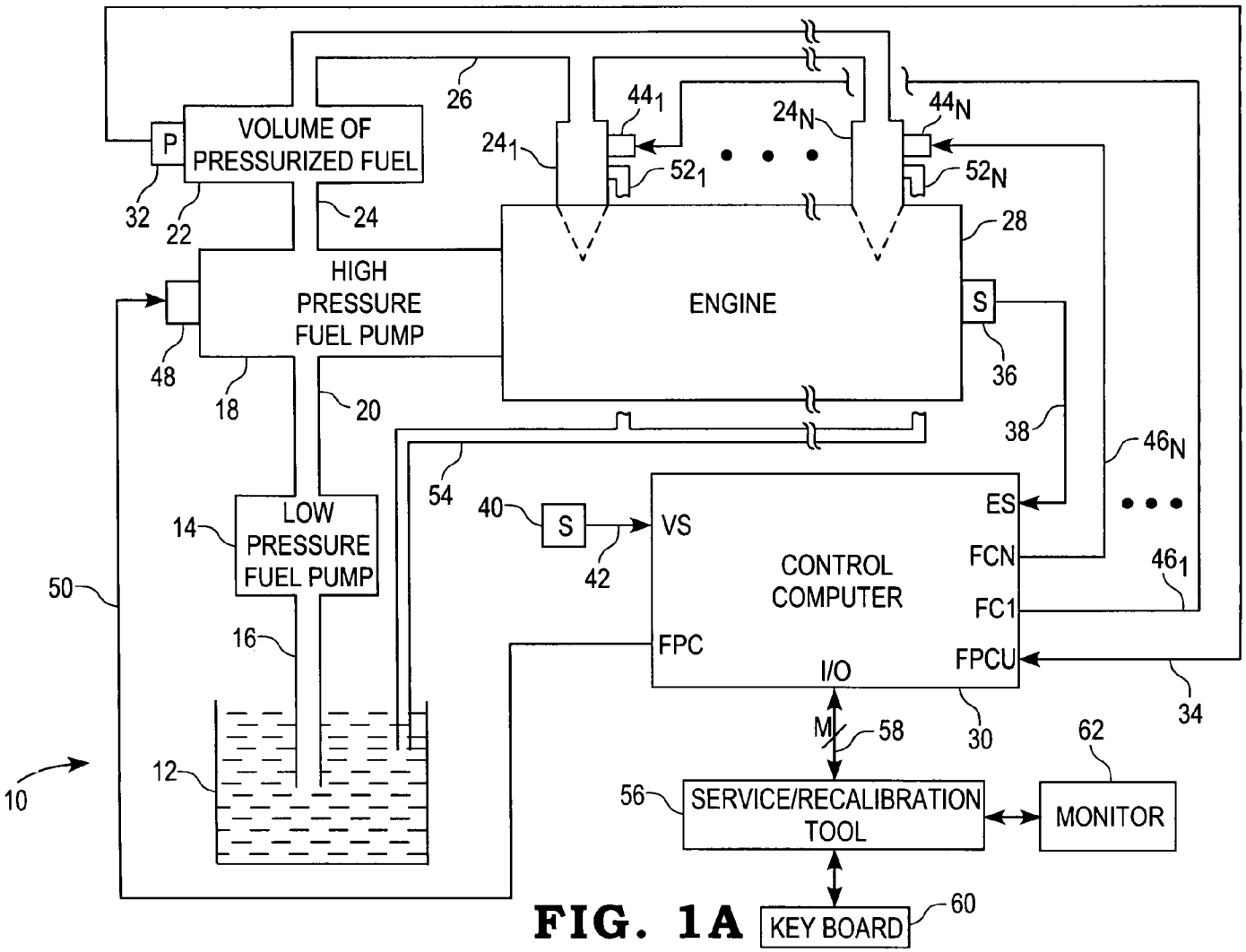
FIG. 1A is a diagrammatic illustration of one embodiment of a system for modifying the pressure level of high-pressure fuel supplied to a high-pressure fuel system for subsequent fuel system leakage testing.

For the purposes of promoting an understanding of the principles of the invention, reference will now be made to a number of illustrative embodiments shown in the drawings and specific language will be used to describe the same. It will nevertheless be understood that no limitation of the scope of the invention is thereby intended.

Referring now to FIG. 1A, a diagram of one illustrative embodiment of a system 10 for modifying the pressure level of high-pressure fuel supplied to a high-pressure fuel system for subsequent fuel system leakage testing is shown. System 10 includes a source of fuel 12; e.g. diesel engine fuel, fluidly coupled to an inlet port of a low-pressure fuel pump 14 via supply passage 16. Low-pressure fuel pump 14 may be of known construction, and in one embodiment is a known gear-driven fuel pump. The outlet of low-pressure fuel pump 14 is fluidly connected to the inlet of a high-pressure fuel pump 18 via supply passage 20. High-pressure fuel pump 18 may also be of known construction, and in one embodiment pump 18 is driven by the engine, as illustrated in block diagram form in FIG. 1A, in a known manner to supply high-pressure fuel from fuel source 12 to a fuel collection unit 22 via supply passage 24. Pump 18 may be configured to supply pressurized fuel in a cyclic or non-cyclic fashion.

Fuel collection unit 22 is fluidly connected to a number, N, of fuel injectors $\mathbf{24}_1$–$\mathbf{24}_N$ via supply passage 26, wherein N may be any positive integer. The "N" fuel injectors $\mathbf{24}_1$–$\mathbf{24}_N$ are each configured to be mounted to an internal combustion engine 28 in fluid communication with a one of a corresponding number of cylinders thereof as is known in the art. In typical applications, for example, a dedicated fuel injector is provided for each of the number of cylinders of the engine 28, although more or fewer fuel injectors may be included within system 10. In the embodiment shown in FIG. 1A, the fuel collection unit 22 is conventionally referred to as a fuel accumulator or fuel storage unit.

System 10 further includes a control computer 30 having a memory unit (not shown) associated therewith. In one embodiment, control computer 30 is a known control computer typically referred to by those skilled in the art as an electronic (or engine) control module (ECM), engine control unit (ECU) or the like, although the present invention contemplates that control computer 30 may alternatively be any circuit capable of performing the functions described hereinafter with respect to control computer 30. In any case, control computer 30 is operable, at least in part, to control the fueling of engine 28 in accordance with one or more software algorithms stored within its memory unit.

System 10 includes a number of sensors and/or sensor subsystems for providing control computer 10 with operational information relating to some of the components of system 10 as well as with certain engine operating information. For example, fuel collection unit 22 includes a pressure sensor 32 in fluid communication therewith and electrically connected to a fuel collection unit pressure input, FPCU, of control computer 30 via signal path 34. Sensor 32 may be of known construction and is in any case operable to sense the pressure of the volume of pressurized fuel within the fuel collection unit 22 and provide a corresponding fuel pressure signal to the fuel collection unit pressure input, FPCU, of control computer 30 via signal path 34.

System 10 further includes an engine speed sensor 36 electrically connected to an engine speed input, ES, of control computer 30 via signal path 38. In one embodiment, sensor 36 is a known Hall effect engine speed/position sensor disposed proximate to a toothed gear or wheel rotating synchronously with the crankshaft of the engine (not shown). In this embodiment, sensor 36 is operable to produce an engine speed/position signal including information relating to the rotational speed of the engine crank shaft (not shown) based on the passage thereby of equi-angularly spaced gear teeth, as well as information relating to engine position relative to a reference engine position (e.g., angle of the crank shaft, or crank angle) relative to a top-dead-center (TDC) position of the engine cylinder in question based on passage thereby of an extra "reference" gear tooth. For purposes of the operation of system 10 as described herein, sensor 36 may alternatively be any known speed sensor configured to produce an engine speed signal corresponding to the rotational speed of engine 30, and to provide the engine speed signal to the engine speed input, ES, of control computer 30.

System 10 further includes a vehicle speed sensor 40 suitably positioned relative to a vehicle carrying engine 28, and electrically connected to a vehicle speed input, VS, of control computer 30. In one embodiment, vehicle speed sensor 40 is a variable reluctance sensor of known construction and operable to produce a speed signal corresponding to the rotational speed of a propeller shaft or tailshaft (not shown) driven by the engine 28. In this embodiment, control computer 28 includes one or more software algorithms configured to process the speed signal produced by sensor 40 and determine therefrom a corresponding vehicle road speed. Alternatively, vehicle speed sensor 40 may be configured to sense rotational speed of one or more other rotating members, e.g., vehicle wheel(s), axle, etc., and produce a corresponding speed signal from which vehicle road speed may be determined. It should be understood, however, that for purposes of system 10 vehicle speed sensor need only be capable of discriminating between a vehicle stationary condition and a vehicle moving condition, and to this end sensor 40 may alternatively be any known sensor, sensing subsystem, virtual sensor or the like, that is operable to produce a road speed signal indicative of whether or not the vehicle is moving.

Control computer 30 includes a number of outputs by which certain components of system 10 may be electronically controlled. For example, each of "N" fueling command signal outputs, FC1–FCN, of control computer 30 is electrically connected to a corresponding one of "N" actuators $\mathbf{44}_1$–$\mathbf{44}_N$ associated each of the number of fuel injectors $\mathbf{24}_1$–$\mathbf{24}_N$. Each of the fuel injector actuators $\mathbf{44}_1$–$\mathbf{44}_N$ may be a solenoid or other known actuator, and is responsive to a corresponding fueling command signal produced by control computer 30 to supply a commanded amount of pressurized fuel from the fuel collection unit 22 to a corresponding cylinder of engine 28. Additionally, each actuator $\mathbf{44}_1$–$\mathbf{44}_N$ is operable to direct unused (non-injected) fuel supplied to an associated fuel injector $\mathbf{24}_1$–$\mathbf{24}_N$ to fuel source 12 via corresponding fuel drain passageways $\mathbf{52}_1$–$\mathbf{52}_N$ and 54, as illustrated in FIG. 1A and as is known in the art.

A fuel pump command output, FPC, of control computer 30 is connected to a fuel pump actuator 48 of the high-pressure fuel pump 18 via signal path 50, wherein actuator 53 may be a solenoid or other known actuator. In any case, actuator 48 of pump 18 is responsive to a pump command signal produced by control computer 30 on signal path 50 to cause the pump 18 to pressurize fuel from fuel supply 12 in a known manner, and to supply the pressurized fuel to the fuel collection unit 22.

System 10 further includes a service/recalibration tool 56 electrically connectable to an input/output (I/O) port of control computer 30 via a number, M, of signal paths 58. Tool 56 is microprocessor-based and includes a memory unit, and in one embodiment signal paths 58 represent a known serial communications link; e.g., SAE-J1708/J1587, SAE-J1939, or the like connecting the microprocessor within tool 56 in data communications with control computer 30, although tool 56 may alternately be connected to the I/O port of control computer 30 via any known serial, parallel, wireless or other communications path configured for communications according to any known communications protocol. Alternatively, tool 56 may represent any auxiliary or general-purpose computer having suitable memory and configured to communicate with control computer 30 via signal paths 58, and configured to execute one or more sets of instructions in the form of one or more software algorithms. In any case, tool 56 includes a keyboard or keypad 60, which may be integral with or separate from tool 56, having a number of manually actuatable keys for communicating information to the internal microprocessor or other computer. Additionally, tool 56 includes a display 62 for displaying text and/or graphic information transmitted thereto by the microprocessor or other computer carried by tool 56.

It is to be understood that in the embodiment illustrated in FIG. 1A, system 10 may include any number of fuel pumps 18, fuel collection units 22, fuel injectors $\mathbf{24}_1$–$\mathbf{24}_N$ and associated passageways. As one specific example, N=6 and system 10 configured for a 6-cylinder engine may include a pair of fuel pumps 18, a pair of fuel collection units 22 and six fuel injectors $\mathbf{24}_1$–$\mathbf{24}_6$, wherein one fuel pump 18 and associated fuel collection unit 22 is operable to supply pressurized fuel to a first bank of three fuel injectors (e.g., front bank) and the other fuel pump 18 and associated fuel collection unit 22 is operable to supply pressurized fuel to a second bank of three fuel injectors (e.g., rear bank). Those skilled in the art will recognize other combinations of fuel pump 18, fuel collection unit 22, fuel injectors $\mathbf{24}_1$–$\mathbf{24}_N$ and associated passageways, and that other such combinations are intended to fall within the scope of the claims appended hereto.

Figure 1B:
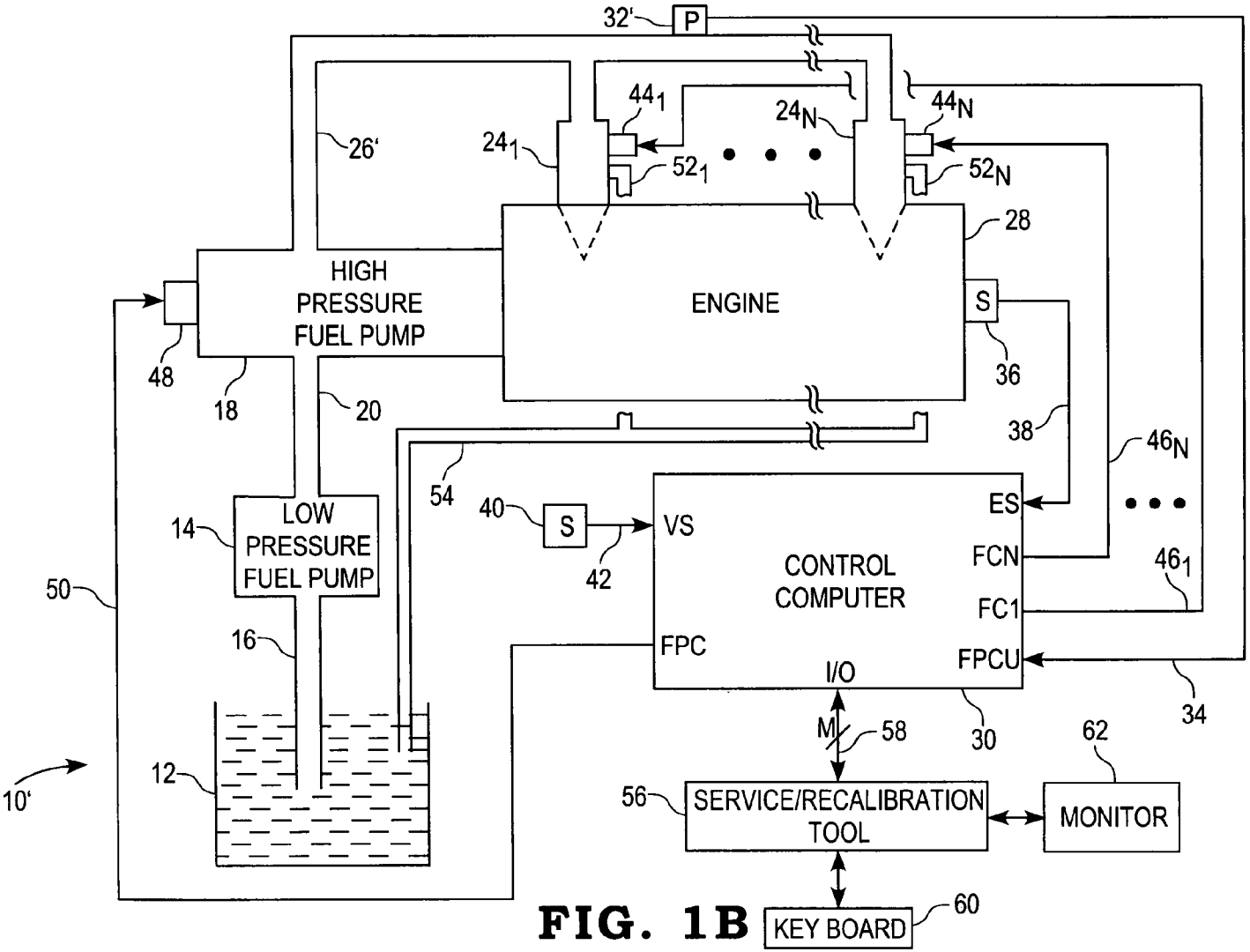
FIG. 1B is a diagrammatic illustration of an alternate embodiment of a system for modifying the pressure level of high-pressure fuel supplied to a high-pressure fuel system for subsequent fuel system leakage testing.

Referring now to FIG. 1B, an alternative embodiment of a system 10' for modifying the pressure level of high-pressure fuel supplied to a high-pressure fuel system for subsequent fuel system leakage testing is shown. System 10' is identical in many respects to system 10 of FIG. 1A, and like reference numbers are therefore used to identify like components. System 10' of FIG. 1B differs from system 10 of FIG. 1A in that fuel pump 18 is fluidly connected directly to a so-called fuel "rail" 26', wherein the fuel rail 26' is fluidly connected to the number of fuel injectors $\mathbf{24}_1$–$\mathbf{24}_N$. In this embodiment, the "fuel collection unit", as this term is used hereinabove, is the fuel rail 26', whereby a pressure sensor 32' suitably located relative to rail 26' is electrically connected to the fuel collection unit pressure input, FPCU, of control computer 30 via signal path 34 as shown in FIG. 1B. It is to be understood that in the embodiment of the fuel control system 10' illustrated in FIG. 1B, any number of fuel pumps 18 and fuel rails 26' may be provided and fluidly connected to any desired combinations or groupings of fuel injectors $\mathbf{24}_1$–$\mathbf{24}_N$, as described with respect to FIG. 1A, to thereby accommodate any desired fuel pump/fuel rail/injector combination or grouping. In any case, it should now be apparent that the term "fuel collection unit", as used herein, may be understood to identify any of an accumulator-type fuel storage unit, such as unit 22 of FIG. 1A, a fuel rail-type storage unit, such as fuel rail 26', or the like.

Under normal operation of the fuel system components illustrated in FIGS. 1A and 1B, control computer 30 is operable, via the fuel pump command signal, FPC, to control the fuel pressure within the fuel collection unit 22 or 26' to achieve desired or default fuel pressure levels therein. The desired or default fuel pressure levels are determined, at least in part, by control computer 30 as a function of requested fueling, wherein engine fueling, in turn, defines a resulting engine output torque and engine load, as is known in the art. Typically at requested fueling levels that result in low engine load values, the corresponding pressure levels within the fuel collection unit 22 or 26' are generally much lower than the maximum allowable fuel collection unit pressure. While it is desirable to check for fuel system and fuel system component leaks under low engine load conditions, such as when the vehicle is stationary, it is also desirable to maintain high fuel pressure levels within the high-pressure fuel injection system during such leak testing to make some leaks easier to detect and identify and/or to allow for the detection and identification of leaks that may occur or become apparent only at fuel system pressure levels above those typically attainable under low engine load conditions. Systems 10 and 10' illustrated in FIGS. 1A and 1B respectively provide for the ability to override the normal fuel system operation just described, and allow control of the fuel pressure within the fuel collection unit 22 or 26' to a target fuel pressure near a maximum allowable fuel collection unit pressure while maintaining low engine load.

Figure 2A:
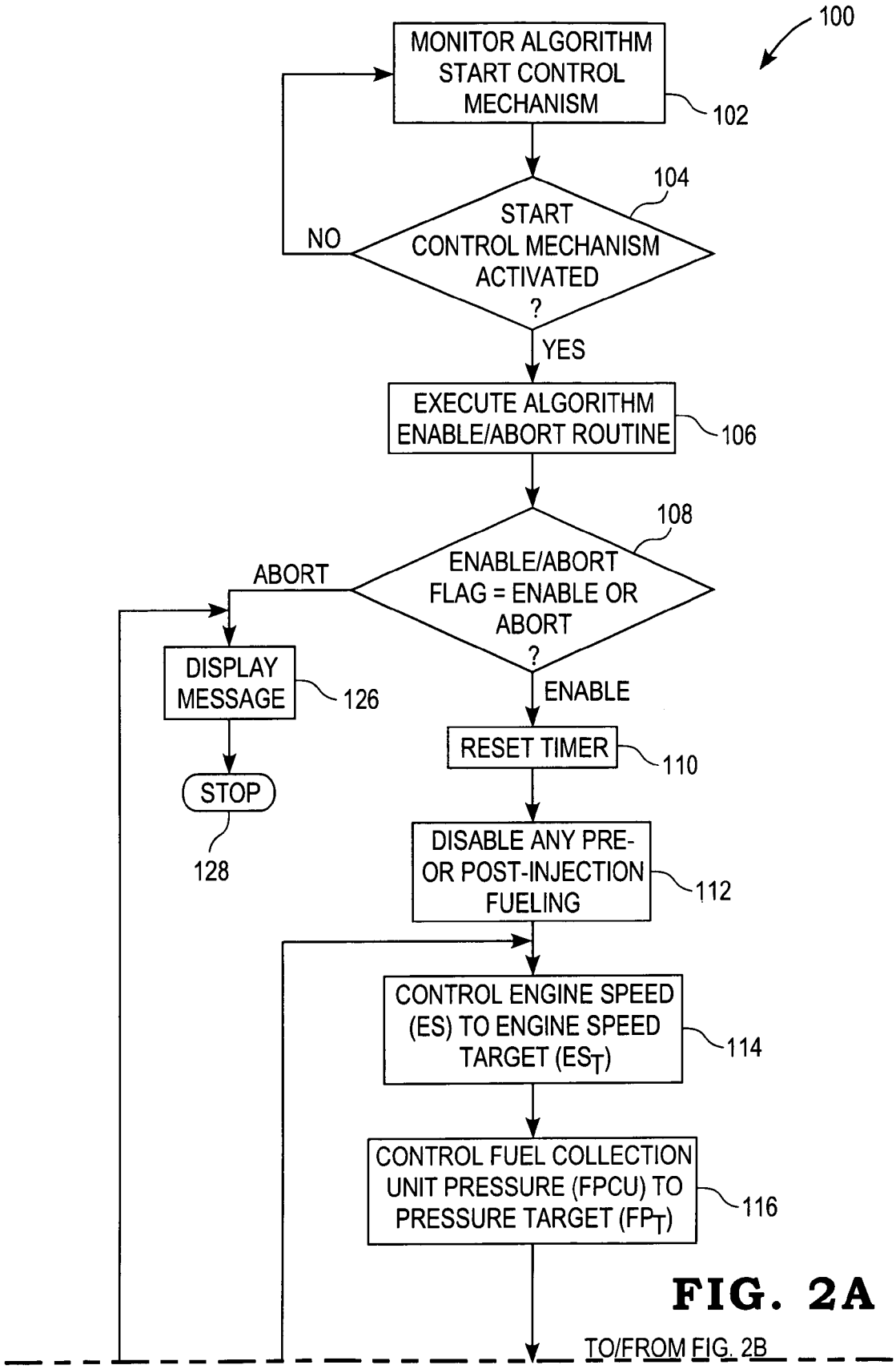
FIGS. 2A–2B represent a flowchart of one illustrative embodiment of a software algorithm for modifying the pressure level of high-pressure fuel in a high-pressure fuel system for subsequent fuel system leakage testing.
Figure 2B:
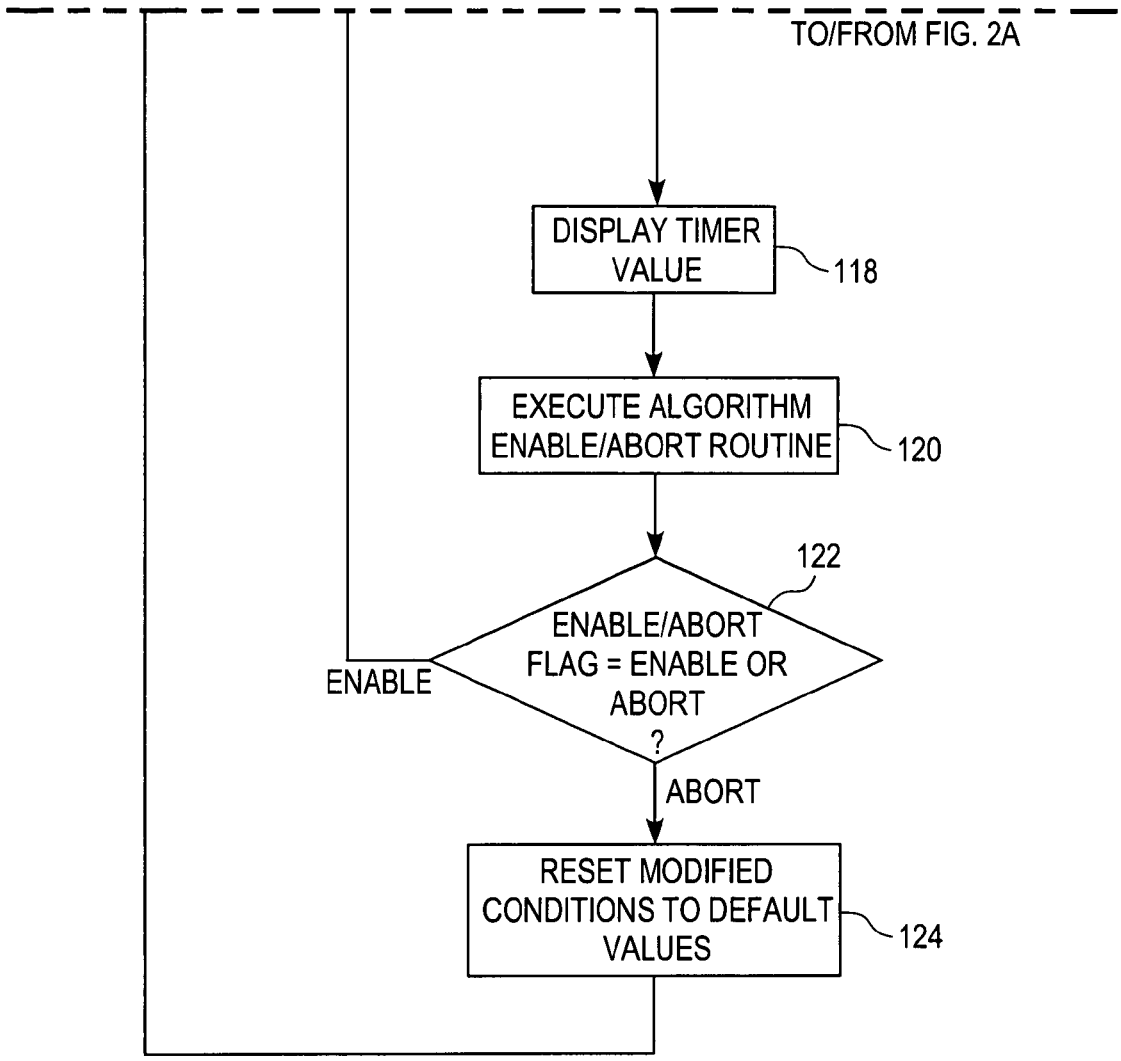

Referring now to FIGS. 2A–2B, a flowchart is shown illustrating one embodiment of a software algorithm 100 for modifying the pressure level of high-pressure fuel in a high-pressure fuel system for subsequent fuel system leakage testing. In one embodiment, algorithm 100 is stored in the memory of the service/recalibration tool 56 and executed by the microprocessor or other computer resident within tool 56 to override the normal operation of control computer 30 and direct control computer 30 to modify the pressure of the high-pressure fuel stored within the fuel collection unit 22 or 26' as will be described in greater detail hereinafter. Alternatively, algorithm 100 may be stored in, and executed by, any auxiliary or general-purpose computer capable of electronic communication with control computer 30 and of operation as will be described hereinafter. Alternatively still, algorithm 100 may be stored within the memory unit associated with control computer 30, and executed by control computer 30 pursuant to instructions to do so by a suitable external source. In the following description of FIGS. 2A and 2B, algorithm 100 will be described as being stored within, and executed by, the service/recalibration tool 56, although it will be understood that algorithm 100 may alternately stored and/or executed as just described. In any case, in the illustrated embodiment algorithm 100 is executed while the engine 30 is running with the vehicle carrying engine 30 in a stationary position. By maintaining the vehicle in a stationary position, engine load is thereby maintained within a range of low engine load values. While accessory loading may cause the actual engine load value to change, any such change will generally not affect the operation of algorithm 100.

Algorithm 100 begins at step 102 where tool 56 is operable to monitor an algorithm start control mechanism; e.g., a "start" key or other key located on keyboard 60, the manual actuation or activation of which triggers tool 26 to begin execution of algorithm 100. Thereafter at step 104, tool 56 is operable to determine whether the algorithm start control mechanism has been activated. If not, algorithm 100 loops back to step 102. If, however, tool 56 determines at step 104 that the algorithm start control mechanism has been activated, algorithm execution advances to step 106 where tool 56 is operable to execute an algorithm enable/abort routine configured to determine, based on a number of system operating parameters, whether execution of the remainder of algorithm 100 should be enabled or aborted.

Figure 3:
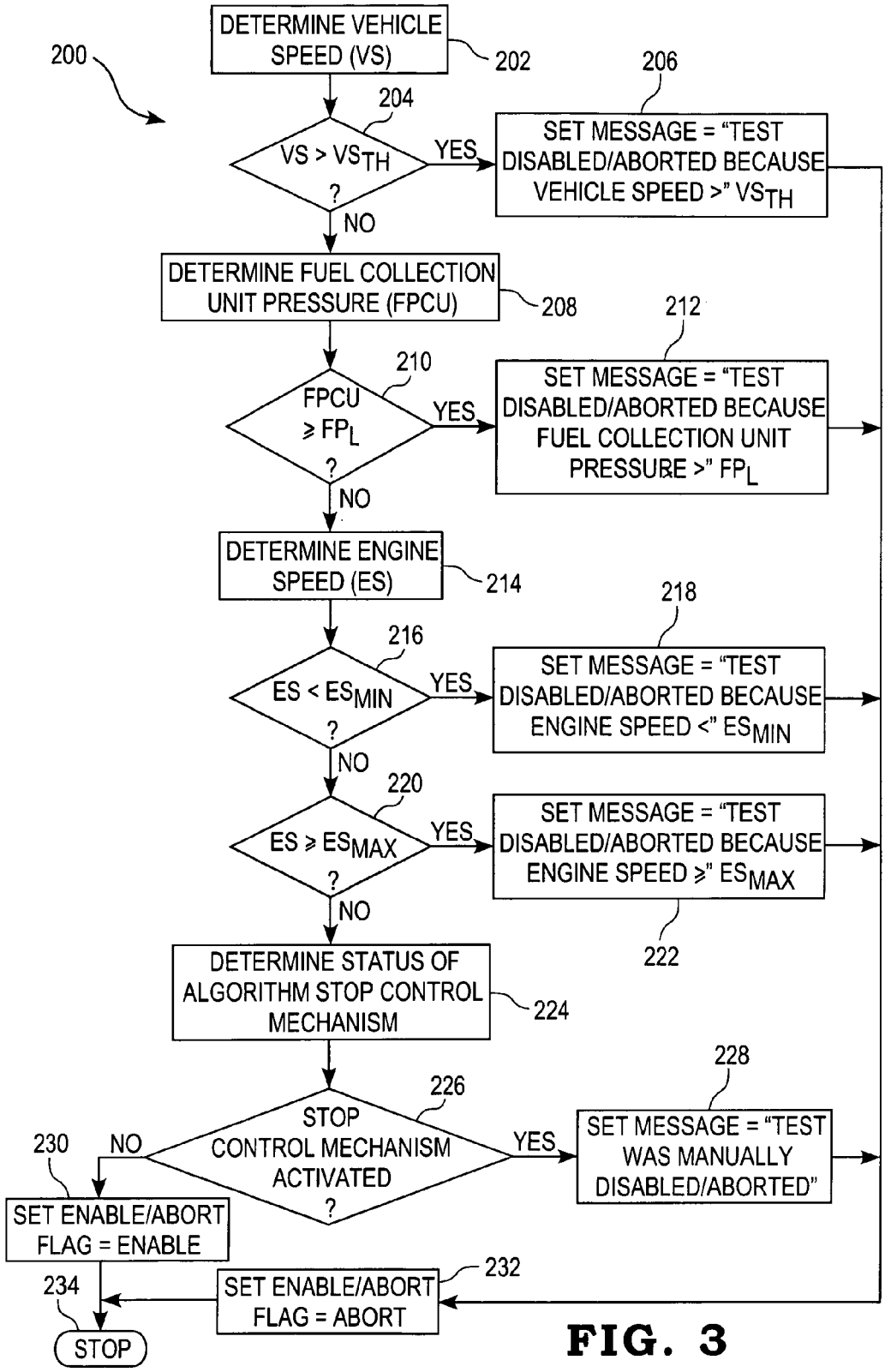
FIG. 3 is a flowchart of one illustrative embodiment of a software routine for executing the algorithm enable/abort step of the algorithm illustrated in FIGS. 2A–2B.

Referring now to FIG. 3, one embodiment of a software algorithm 200 for executing the algorithm enable/abort routine of step 106 of algorithm 100 is shown. Algorithm 200 begins at step 202 where tool 56 is operable to determine the current vehicle speed, VS. Control computer 30 is generally operable, as is known in the art, to broadcast certain engine and/or vehicle operating information over two serial data networks coupled to control computer 30; namely the SAE J-1708 and SAE J1939 serial data networks. For example, control computer 30 is generally operable to broadcast over both the J-1708 and J1939 serial data networks the current road speed signal produced by vehicle speed sensor 40. In embodiments wherein tool 56 is electrically connected to control computer 30 via either the J-1708 serial data link or the J-1939 serial data link, as described hereinabove, tool 56 is operable to execute step 202 by monitoring the serial data link for current road speed information broadcast by control computer 30. In other embodiments wherein tool 56 is electrically connected to the I/O port of control computer 30 via an alternate form of signal paths 58 upon which control computer 30 is not operable to broadcast current road speed information, tool 56 is operable to execute step 202 by requesting current road speed information from control computer 30 via signal paths 58 in a known manner. In any case, algorithm execution advances from step 202 to step 204 where tool 56 is operable to determine whether current vehicle speed, VS, is greater than a threshold value $VS_{TH}$. In one embodiment, $VS_{TH}$ is set to zero to determine whether the vehicle is or is not moving. Alternatively, the vehicle speed threshold $VS_{TH}$ may be set to some other positive vehicle speed threshold value in cases where the vehicle may be allowed to move during leak testing of the fuel system. In either case, if tool 56 determines at step 204 that vehicle speed, VS, is greater than $VS_{TH}$, algorithm execution advances to step 206 where tool 56 is operable to set the current message to "TEST DISABLED/ABORTED BECAUSE VEHICLE SPEED>" $VS_{TH}$. Otherwise if tool 56 determines at step 204 that vehicle speed, VS, is less than or equal $VS_{TH}$, algorithm execution advances to step 208.

At step 208, tool 56 is operable to determine the current fuel pressure, FPCU, within the fuel collection unit pressure. In some embodiments, control computer 30 is operable to broadcast over the J1939 serial data network the fuel pressure, FPCU, produced by the fuel pressure sensor 32 or 32'. In embodiments wherein tool 56 is electrically connected to control computer 30 via the J-1939 serial data link, as described hereinabove, tool 56 is operable to execute step 208 by monitoring the serial data link for current road speed information broadcast by control computer 30. In other embodiments wherein tool 56 is electrically connected to the I/O port of control computer 30 via an alternate form of signal paths 58 upon which control computer 30 is not operable to broadcast current fuel collection unit pressure information, or in embodiments wherein signal paths 58 represent a J1939 serial data link but control computer 30 is not operable to broadcast the current fuel collection unit pressure value over the J1939 link, tool 56 is operable to execute step 208 by requesting the current fuel collection unit pressure information from control computer 30 via signal paths 58 in a known manner. In any case, algorithm execution advances from step 208 to step 210 where tool 56 is operable to determine whether current fuel pressure, FPCU, within the fuel collection unit 22 or 26' is greater than or equal to a fuel pressure limit, $FP_L$. In one embodiment the fuel pressure limit, $FP_L$, is set to the maximum allowable fuel collection unit fuel pressure level, $FPCU_{MAX}$. In one specific embodiment, for example, a typical value for $FPCU_{MAX}$ may be 1750 bar. Alternatively, the fuel pressure limit, $FP_L$, at step 210 may be se to some other fuel pressure value less than the maximum allowable fuel collection unit fuel pressure level, $FPCU_{MAX}$. In either case, if tool 56 determines at step 210 that the fuel pressure, FPCU, within the fuel collection unit 22, 26' is greater than or equal to the fuel pressure limit $FP_L$, algorithm execution advances to step 212 where tool 56 is operable to set the current message to "TEST DISABLED/ABORTED BECAUSE THE FUEL COLLECTION UNIT PRESSURE≧" $FP_L$. Otherwise if tool 56 determines at step 210 that FPCU, is less than $FP_L$, algorithm execution advances to step 214.

At step 214, tool 56 is operable to determine the current engine speed, ES. Control computer 30 is generally operable to broadcast over both the J-1708 and J1939 serial data networks the current engine speed signal produced by engine speed sensor 36. In embodiments wherein tool 56 is electrically connected to control computer 30 via either the J-1708 serial data link or the J-1939 serial data link, as described hereinabove, tool 56 is operable to execute step 214 by monitoring the serial data link for current engine speed information broadcast by control computer 30. In other embodiments wherein tool 56 is electrically connected to the I/O port of control computer 30 via an alternate form of signal paths 58 upon which control computer 30 is not operable to broadcast current engine speed information, tool 56 is operable to execute step 214 by requesting current engine speed information from control computer 30 via signal paths 58 in a known manner. In any case, algorithm execution advances from step 214 to step 216 where tool 56 is operable to determine whether current engine speed, ES, is less than a minimum engine speed value $ES_{MIN}$. In one embodiment, $ES_{MIN}$ is set to a minimum engine idle speed value, and in one specific embodiment $ES_{MIN}$ is, for example, 600 rpm. Alternatively, the minimum engine speed value $ES_{MIN}$ may be set to some other low engine speed value. In either case, if tool 56 determines at step 216 that engine speed, ES, is less than $ES_{MIN}$, algorithm execution advances to step 218 where tool 56 is operable to set the current message to "TEST DISABLED/ABORTED BECAUSE ENGINE SPEED<" $ES_{MIN}$. Otherwise if tool 56 determines at step 216 that engine speed, ES, is greater than or equal $ES_{MIN}$, algorithm execution advances to step 220 where tool 56 is operable to determine whether current engine speed, ES, is greater than or equal to a maximum engine speed value $ES_{MAX}$. In one embodiment, $ES_{MAX}$ is set to a maximum engine idle speed value, and in one specific embodiment $ES_{MAX}$ is, for example, 1500 rpm. Alternatively, the maximum engine speed value $ES_{MAX}$ may be set to some other low engine speed value above $ES_{MIN}$ such that ES is within a predefined range of low engine speeds. In either case, if tool 56 determines at step 220 that engine speed, ES, is greater than or equal to $ES_{MAX}$, algorithm execution advances to step 222 where tool 56 is operable to set the current message to "TEST DISABLED/ABORTED BECAUSE ENGINE SPEED≧" $ES_{MAX}$. Otherwise if tool 56 determines at step 220 that engine speed, ES, is less than $ES_{MAX}$, and is therefore within a predefined range of low engine speeds, algorithm execution advances to step 224.

At step 224, tool 56 is operable to monitor an algorithm stop control mechanism; e.g., a "stop" key or other key located on keyboard 60, the manual actuation or activation of which triggers tool 26 to stop execution of algorithm 100, and determine the status thereof. Thereafter at step 226, tool 56 is operable to determine whether the algorithm stop control mechanism has been activated. If so, algorithm execution advances to step 228 where tool 56 is operable to set the current message to "TEST WAS MANUALLY DISABLED/ABORTED. Otherwise if tool 56 determines at step 226 that the algorithm stop control mechanism has not been activated, algorithm execution advances to step 230 where tool 56 is operable to indicate that all of the algorithm enable conditions have been satisfied by setting an enable/abort flag to ENABLE. On the other hand, algorithm execution advances from any of message steps 206, 212, 218, 222 and 228 to step 232 where tool 56 is operable to indicate that one or more of the algorithm abort conditions have been satisfied by setting the enable/abort flag to ABORT. Execution of algorithm 200 advances from either of steps 230 and 232 to step 234 where algorithm 200 is returned to step 106 of algorithm 100.

Those skilled in the art will recognize that algorithm 200 represents only one illustrative collection of algorithm 100 enable/abort conditions, and that this collection may alternatively exclude some of the listed conditions and/or include other engine, vehicle and/or fuel system operating conditions that are not included in algorithm 100. Any such alternate collection of enable/abort conditions will typically be dictated by the application, and is intended to fall within the scope of the claims appended hereto.

Referring again to FIG. 2A, execution of algorithm 100 advances from step 106 to step 108 where tool 56 is operable to determine the status of the enable/abort flag. If, at step 108, tool 56 determines that the enable/abort flag is set to ENABLE, algorithm execution advances to step 110 where tool 56 is operable to reset a timer. Thereafter at optional step 112, tool 56 is operable to disable any pre- or post-injection fueling, if the fuel system under test includes any such pre- or post-injection capability. In general, pre-injection or "pilot" injection fueling is a known process for injecting small quantities of fuel prior to the main fuel injection event for at least the purposes of maintaining smooth engine idling operation and reducing unwanted exhaust emissions. Post-injection fueling is also a known process for injecting small quantities of fuel after the main fuel injection event for the primary purpose of reducing unwanted exhaust emissions. In either case, by increasing the fuel pressure within the fuel collection unit 22, 26' near the maximum allowable fuel collection unit fuel pressure level while maintaining engine speed at an engine rotational speed within a range of low engine rotational speeds in accordance with algorithm 100, the on-time durations of the fuel injector actuators $\mathbf{44}_1$–$\mathbf{44}_N$ required for pre- or post-injection fueling may as a result become shorter than the response times of the actuators $\mathbf{44}_1$–$\mathbf{44}_N$. In such cases, step 112 is included to disable pre- and/or post-injection fueling events. In cases where the fuel system under test has no such pre- or post-injection fueling capabilities, step 112 may be omitted from algorithm 100. Tool 56 is operable to execute step 112 by sending a suitable pre- and/or post-injection fueling disable request to control computer via signal paths 58. Control computer 30 is, in turn, responsive to such a request to disable pre- and/or post-fueling injection events.

From step 112, or from step 110 if step 112 is omitted, algorithm 100 advances to step 114 where tool 56 is operable to control the engine rotational speed, ES, to a target engine speed value, $ES_T$. $ES_T$, in one embodiment, is an engine speed value within a range of engine idle speeds; e.g., 1000 rpm. Alternatively, $ES_T$ may be within any desired range of engine speeds. Alternatively still, tool 56 may be operable at step 114 to vary engine speed, ES, or to bypass step 114 altogether since the engine speed value will typically have negligible effect on engine load as long as the vehicle is stationary. In the illustrated embodiment, engine speed is controlled at step 114 to an engine speed target, $ES_T$, corresponding to an engine speed within a range of engine idle speeds primarily to minimize noise produced by the engine 30 while subsequently executing the fuel system leak test.

In one embodiment, tool 56 is operable to control the engine rotational speed to $ES_T$ by sending the target engine speed value, $ES_T$, to control computer 30 via communication link 58 as an engine speed override value. The control computer 30 is, in turn, responsive to the target engine speed value, $ES_T$, to control the rotational speed of the engine 28 to $ES_T$ by adjusting the fueling command signals, FC1–FCN, to the various fuel injectors, $\mathbf{24}_1$–$\mathbf{24}_N$ in a manner that achieves the target engine speed value, $ES_T$. Alternatively, tool 56 may be operable at step 114 to send to control computer 30 via communication link 58 a target fuel command value that corresponds to the target engine speed value, $ES_T$. In this embodiment, control computer 30 is operable to adjust the fueling command signals, FC1–FCN, to the various fuel injectors, $\mathbf{24}_1$–$\mathbf{24}_N$, to the target fuel command value to thereby achieve an engine speed of $ES_T$. In either case, tool 56 is operable to control the rotational speed of engine 28 to the target engine rotational speed, $ES_T$, at step 114 by directing the control computer 30 to modify the fueling command signals, FC1–FCN, to the various fuel injectors, $\mathbf{24}_1$–$\mathbf{24}_N$, such that the resulting engine rotational speed is controlled to $ES_T$.

Optionally, tool 56 may also be operable at step 114 to override the control computer's control over the throttle percentage prior to commanding $ES_T$. This optional feature may be implemented to effectively disable the accelerator pedal as a safety precaution against manipulation of the accelerator during leak testing of the fuel system. If included, tool 56 may be operable to implement this feature by sending to control computer 30 via communication link 58 a throttle override request followed by a 0% throttle command value. Control computer 30 is responsive to the throttle override request to ignore the throttle percentage value requested by the accelerator pedal and instead implement the 0% throttle command value sent by tool 56.

Following step 114, algorithm execution advances to step 116 where tool 56 is operable to control the fuel collection unit pressure, FPCU, to a target fuel pressure value, $FP_T$. In one embodiment, $FP_T$ is set near the maximum allowable fuel collection unit fuel pressure level, $FPCU_{MAX}$, and in one example implementation, $FP_T$=1500 bar and $FPCU_{MAX}$=1750 bar. It is generally desirable to increase the fuel pressure level, FPCU, in the fuel collection unit 22, 26' at step 116 to a sufficiently high-pressure level that will allow fuel system leaks to be identified in the subsequent leak testing of the fuel system. The phrase "near the maximum allowable fuel collection unit pressure level" is thus intended to define a band or window of fuel pressure values between a minimum fuel pressure that will allow for satisfactory identification of fuel leaks in the subsequent leak testing of the fuel system and the maximum allowable fuel collection unit pressure level, $FPCU_{MAX}$. In one embodiment, tool 56 is operable to control the fuel collection unit fuel pressure, FPCU, to $FP_T$ by sending the target fuel pressure value, $FP_T$, to control computer 30 via communication link 58 as a fuel collection unit fuel pressure override value. The control computer 30 is, in turn, responsive to the target fuel pressure value, $FP_T$, to control the fuel pressure within the fuel collection unit 22, 26' to $FP_T$ by adjusting the fuel pump command signal, FPC, to the high-pressure fuel pump 18 in a manner that achieves the target fuel pressure, $FP_T$, in the fuel collection unit 22, 26'. Alternatively, tool 56 may be operable at step 116 to send to control computer 30 via communication link 58 a target fuel pump command value that corresponds to the target fuel pressure value, $FP_T$. In this embodiment, control computer 30 is operable to adjust the fuel pump command signal, FPC, to the high-pressure fuel pump 18 to the target fuel pump command value to thereby achieve a fuel collection unit fuel pressure value of $FP_T$. In either case, tool 56 is operable to control the fuel collection unit fuel pressure to the target fuel pressure, $FP_T$, at step 116 by directing the control computer 30 to modify the fuel pump command signal, FPC, to the fuel pump 18 such that the resulting fuel pressure, FPCU, within the fuel collection unit 22, 26' is controlled to $FP_T$.

From step 116, algorithm execution advances to step 118 where tool 56 is operable to display the elapsed time of the timer (not shown) on the monitor 62. Step 118 provides for the display of the amount of time that the fuel pressure, FPCU, within the fuel collection unit 22, 26' has been increased to $FP_T$. Thereafter at step 120, tool 56 is again operable to execute the algorithm enable/abort routine described hereinabove with respect to step 106. Following step 120, tool 56 is operable at step 122 where tool 56 is operable to determine the status of the enable/abort flag. If, at step 122, tool 56 determines that the enable/abort flag is set to ENABLE, algorithm execution loops back to step 114. As long as the enable/abort flag is set to ENABLE at step 122, tool 56 is operable to continually executes the loop defined by steps 114–122, wherein the fuel pressure, FPCU, within the fuel collection unit 22, 26' is controlled to the target fuel pressure value, $FP_T$, while maintaining the engine speed, ES, at the target engine speed value, $ES_T$. During the continued execution of this loop, leak testing of the fuel system may be conducted in a known manner. The timer value indicates the elapsed time of execution of the loop.

If, at step 122, the enable abort flag is set to ABORT, algorithm execution advances to step 124 where tool 56 is operable to reset the modified operational conditions to their default values; i.e., the values that they would have had absent algorithm 100. For example, tool 56 is operable at step 124 to return control of the engine speed, ES, the fuel pressure, FPCU, within the fuel collection unit 22, 26', and any pre- or post-injection fueling to the control computer 30. From step 124, and if tool 56 determines at step 108 that the enable/abort flag is set to ABORT, algorithm execution advances to step 126 where tool 56 is operable to display the current message value that was set by algorithm 200. Thereafter at step 128, execution of algorithm 100 stops.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. System for modifying fuel pressure in a high-pressure fuel injection system of an internal combustion engine, the system for modifying fuel pressure comprising:

a fuel collection unit configured to store high-pressure fuel therein;

at least one fuel injector configured to supply fuel from the fuel collection unit to the engine; and means for controlling fuel pressure within the fuel collection unit to a target fuel pressure near a maximum allowable fuel collection unit fuel pressure level while maintaining low engine load.

2. The system of claim 1 further including a vehicle speed sensor producing a vehicle speed signal indicative of road speed of a vehicle carrying said engine;

and wherein the means for controlling fuel pressure further includes means for controlling fuel pressure within the fuel collection unit to the target fuel pressure while maintaining low engine load only while the vehicle speed signal indicates that the vehicle is not moving.

3. The system of claim 1 further including an engine speed sensor producing an engine speed signal indicative of the rotational speed of the engine;

and wherein the means for controlling fuel pressure further includes means for controlling fuel pressure within the fuel collection unit to the target fuel pressure while maintaining low engine load only while the engine speed signal indicates that the rotational speed of the engine is within a predefined range of engine speeds.

4. The system of claim 1 further including a pressure sensor producing a pressure signal indicative of fuel pressure within the fuel collection unit;

and wherein the means for controlling fuel pressure further includes means for controlling fuel pressure within the fuel collection unit to the target fuel pressure while maintaining low engine load only while the pressure signal indicates that the fuel pressure within the fuel collection unit is below a fuel pressure limit.

5. The system of claim 1 further including further including:

a vehicle speed sensor producing a vehicle speed signal indicative of road speed of a vehicle carrying said engine;

an engine speed sensor producing an engine speed signal indicative of the rotational speed of the engine; and a pressure sensor producing a pressure signal indicative of fuel pressure within the fuel collection unit;

and wherein the means for controlling fuel pressure further includes means for controlling fuel pressure within the fuel collection unit to the target fuel pressure while maintaining low engine load only while the vehicle speed signal indicates that the vehicle is not moving, the engine speed signal indicates that the rotational speed of the engine is within a predefined range of engine speeds and the pressure signal indicates that the fuel pressure within the fuel collection unit is below a fuel pressure limit.

6. The system of claim 1 further including a high-pressure fuel pump responsive to a fuel pump control signal to supply high-pressure fuel from a low-pressure fuel source to the fuel collection unit;

and wherein the means for controlling fuel pressure further includes means for modifying the fuel pump control signal to control the fuel pressure within the fuel collection unit to the target fuel pressure.

7. The system of claim 1 wherein the means for controlling fuel pressure includes means for controlling fuel pressure within the fuel collection unit to a target fuel pressure near a maximum allowable fuel collection unit fuel pressure level while maintaining low engine load and while controlling rotational speed of the engine to a target engine speed value.

8. The system of claim 7 wherein the at least one fuel injector is responsive to a fueling command signal produced by the means for controlling fueling pressure to supply fuel from the fuel collection unit to the engine;

and wherein the means for controlling fuel pressure within the fuel collection unit to a target fuel pressure near a maximum allowable fuel collection unit fuel pressure level while maintaining low engine load and while controlling rotational speed of the engine to a target engine speed value includes means for modifying the fueling command signal to control the rotational speed of the engine to the target engine speed value.

9. The system of claim 1 wherein the means for controlling fuel pressure further includes means for maintaining low engine load by maintaining a vehicle carrying the engine in a stationary position.

10. System for modifying fuel pressure in a high-pressure fuel injection system of an internal combustion engine, the system for modifying fuel pressure comprising:

a fuel collection unit configured to store high-pressure fuel therein;

a fuel injector configured to supply fuel from the fuel collection unit to the engine;

a control structure configured to control the fuel pressure within the fuel collection unit to a target fuel pressure near a maximum allowable fuel collection unit fuel pressure level while maintaining low engine load.

11. The system of claim 10 wherein the control structure includes:

a control computer configured to control fuel pressure within the fuel collection unit and to control engine fueling; and an auxiliary computer connected in electronic communication with the control computer, the auxiliary computer configured to direct the control computer to control the fuel pressure within the fuel collection unit to the target fuel pressure while maintaining low engine load.

12. The system of claim of claim 10 wherein the control structure includes a control computer configured to control fuel pressure within the fuel collection unit and to control engine fueling, the control computer further configured to control the fuel pressure within the fuel collection unit to the target fuel pressure while maintaining low engine load.

13. The system of claim 10 wherein the control structure is configured to maintain low engine load by maintaining a vehicle carrying the engine in a stationary position.

14. The system of claim 10 further including a vehicle speed sensor producing a vehicle speed signal indicative of road speed of a vehicle carrying said engine;

and wherein the control structure is configured to control the fuel pressure within the fuel collection unit to the target fuel pressure while maintaining low engine load only while the vehicle speed signal indicates that the vehicle is not moving.

15. The system of claim 10 further including an engine speed sensor producing an engine speed signal indicative of the rotational speed of the engine;

and wherein the control structure is configured to control the fuel pressure within the fuel collection unit to the target fuel pressure while maintaining low engine load only while the engine speed signal indicates that the rotational speed of the engine is within a predefined range of engine speeds.

16. The system of claim 10 further including a pressure sensor producing a pressure signal indicative of fuel pressure within the fuel collection unit;

and wherein the control structure is configured to control the fuel pressure within the fuel collection unit to the target fuel pressure while maintaining low engine load only while the pressure signal indicates that the fuel pressure within the fuel collection unit is below a fuel pressure limit.

17. The system of claim 10 further including further including:

a vehicle speed sensor producing a vehicle speed signal indicative of road speed of a vehicle carrying said engine;

an engine speed sensor producing an engine speed signal indicative of the rotational speed of the engine; and a pressure sensor producing a pressure signal indicative of fuel pressure within the fuel collection unit;

and wherein the control structure is configured to control the fuel pressure within the fuel collection unit to the target fuel pressure while maintaining low engine load only while the vehicle speed signal indicates that the vehicle is not moving, the engine speed signal indicates that the rotational speed of the engine is within a predefined range of engine speeds and the pressure signal indicates that the fuel pressure within the fuel collection unit is below a fuel pressure limit.

18. The system of claim 10 further including a high-pressure fuel pump responsive to a fuel pump control signal produced by the control computer to supply high-pressure fuel from a low-pressure fuel source to the fuel collection unit;

and wherein the control structure is configured to modify the fuel pump control signal to control the fuel pressure within the fuel collection unit to the target fuel pressure.

19. The system of claim 10 wherein the control structure is configured to control the fuel pressure within the fuel collection unit to a target fuel pressure near a maximum allowable fuel collection unit fuel pressure level while maintaining low engine load and while also controlling engine speed to a target engine speed.

20. The system of claim 19 wherein the at least one fuel injector is responsive to a fueling command signal produced by the control computer to supply fuel from the fuel collection unit to the engine;

and wherein the control structure is configured to modify the fueling command signal to control engine speed to the target engine speed.

21. A method for modifying fuel pressure in a high-pressure fuel injection system of an internal combustion engine, the high-pressure fuel injection system including a fuel collection unit storing high-pressure fuel therein and at least one fuel injector supplying fuel from the fuel collection unit to the engine, the method comprising:

controlling engine load to within a range of low engine loads; and controlling fuel pressure within the fuel collection unit to a target fuel pressure near a maximum allowable fuel collection unit fuel pressure level while maintaining engine load within the range of low engine loads.

22. The method of claim 21 further including controlling engine speed to within a range of engine speeds prior to controlling fuel pressure to the target fuel pressure.

23. The method of claim 21 wherein the act of controlling engine load to within a range of low engine loads includes maintaining a vehicle carrying the engine in a stationary position.

24. The method of claim 21 further including continually executing the act of controlling fuel pressure within the fuel collection unit only while a vehicle carrying the engine is not moving.

25. The method of claim 21 further including continually executing the act of controlling fuel pressure within the fuel collection unit only while engine rotational speed is within a predefined range of engine speeds.

26. The method of claim 21 further including continually executing the act of controlling fuel pressure within the fuel collection unit only while the fuel pressure within the fuel collection unit is below a fuel pressure limit.

* * * * *